US008568185B2

(12) United States Patent
Cho

(10) Patent No.: US 8,568,185 B2
(45) Date of Patent: Oct. 29, 2013

(54) DUAL EXTERNAL ELECTRODE FLUORESCENT LAMP AND MANUFACTURING METHOD THEREOF

(76) Inventor: Cheongyeol Cho, Gyeongsangnam-do (KR)

( * ) Notice: Subject to any disclaimer, the term of this patent is extended or adjusted under 35 U.S.C. 154(b) by 87 days.

(21) Appl. No.: 13/264,647

(22) PCT Filed: May 15, 2009

(86) PCT No.: PCT/KR2009/002589
§ 371 (c)(1),
(2), (4) Date: Oct. 14, 2011

(87) PCT Pub. No.: WO2010/131790
PCT Pub. Date: Nov. 18, 2010

(65) Prior Publication Data
US 2012/0056532 A1 Mar. 8, 2012

(51) Int. Cl.
*H01J 9/00* (2006.01)

(52) U.S. Cl.
USPC ..... 445/26; 445/22; 445/44; 313/607

(58) Field of Classification Search
USPC ..... 445/22–23, 44, 26; 313/607, 623, 634
See application file for complete search history.

(56) References Cited

U.S. PATENT DOCUMENTS

| | | | | |
|---|---|---|---|---|
| 4,082,392 | A * | 4/1978 | Golin | 445/26 |
| 5,340,346 | A * | 8/1994 | Muzeroll | 445/26 |
| 8,262,428 | B2 * | 9/2012 | Lesch et al. | 445/26 |
| 2003/0234613 | A1 * | 12/2003 | Ramaiah et al. | 313/634 |

FOREIGN PATENT DOCUMENTS

| | | |
|---|---|---|
| JP | 2001093465 | 4/2001 |
| KR | 20040061436 | 7/2004 |

* cited by examiner

*Primary Examiner* — Anne Hines
(74) *Attorney, Agent, or Firm* — IPLA P.A.; James E. Bame

(57) ABSTRACT

A dual external electrode fluorescent lamp and manufacturing method thereof comprising a 1$^{st}$ glass tube with both ends open and an inner wall optionally coated with a fluorescent material, wherein the diameter of the opened ends is extended; connecting the 1$^{st}$ glass tube with two 2$^{nd}$ glass tubes by joining both opened ends of the 1$^{st}$ glass tube to the two both-end opened 2$^{nd}$ glass tubes that have a diameter larger than that of the 1$^{st}$ glass tube; joining a 1$^{st}$ multi-tube for the enlargement of an electrode area in the one 2$^{nd}$ glass tube or a 'flare' structure having one closed end to one end of 2$^{nd}$ glass tube through insertion after spreading one end widely, and enlarging an electrode area in the other 2$^{nd}$ tube and joining a 2$^{nd}$ multi-tube having an exhaust port to the other 2$^{nd}$ tube through insertion; cutting and sealing a portion of the exhaust port after vacuuming the inside of the glass tubes and injecting discharge gas inside the glass tubes through the connection of an exhaust system to the exhaust port.

13 Claims, 1 Drawing Sheet

(a)

(b)

DUAL EXTERNAL ELECTRODE FLUORESCENT LAMP AND MANUFACTURING METHOD THEREOF

BACKGROUND OF THE INVENTION

The present invention relates to an external electrode fluorescent lamp (EEFL) and manufacturing method thereof.

The present invention relates to an external electrode fluorescent lamp (EEFL) and manufacturing method thereof, more particularly, to a manufacturing method of a dual external electrode fluorescent lamp wherein a separate glass tube having a different diameter from that of an electrode-less fluorescent lamp is connected to the both ends of the lamp so that the total length of the external electrode fluorescent lamp and the length of the external electrode could be decreased.

A liquid crystal display is a light-emitting flat display device, but it cannot emit light to form images by itself. Since it is a light-receiving flat display device that has to receive light from outside to form images, it has a problem that the images cannot be seen in darkness.

To solve above problem, a back light is provided on the back face of the liquid crystal display for radiating light so that the images can be seen in darkness. General properties required for the back light may comprise high luminance, high efficiency, uniformity of the luminance, long life, thinness, low weights, and low prices, etc.

In conventional arts, A cold cathode fluorescent lamp (CCFL) had been widely used as the back light, but the problem is that it operates only at high luminance and the effective life of the lamp is short. In this regards, as the back light, the external electrode fluorescent lamp has been widely used recently.

The external electrode fluorescent lamp is a fluorescent lamp having structure to form plasma in the lamp by the electric field of the external electrodes, which is formed at external sides of both ends of the lamp that has gases in a closed glass tube, and which performs the electric discharge operation of the gases without exposure of the electrodes in the discharge space. Although the electric discharge of the gases inside of the tube is the same as that inside a typical lamp, since the glass tube itself acts as a dielectric material and wall charges are added due to the deposition of space charges generated by discharging before the external voltage applied for inducing discharge, a voltage gain generates.

The external electrode fluorescent lamp is one of the next-generation lamps for illumination, having, in contrast to the typical lamp such as the cold cathode fluorescent lamp, etc. its electrodes at outside, using the electron emission by the electric field so that heat cannot be generated, having effect life about five times longer than and brightness about ten times brighter than that of a typical fluorescent lamp, and having energy efficiency about five times greater than that of the cold cathode fluorescent lamp. In addition, as the external electrode fluorescent lamp has more advantages such as the ability of driving multiple tubes with different driving devices, it has been widely used in usages such as LCD TVs, advertisement panels, etc. which require high brightness.

Meanwhile, the diameter of the tube relates to brightness and quantity of light. The smaller the diameter of the tube, the greater the brightness but the smaller the quantity of light as the light emitting area of the fluorescent lamp is smaller. On the other hand, The larger the diameter of the tube, the smaller the brightness but the light emitting area is increased so that the lamp may be applied in a high power lamp that require large quantity of light. Especially, for obtaining high brightness the external electrode fluorescent lamp having thin tube of small diameter has been used, but it's quantity of light is small. For compensating this, if the tube diameter is increased then the brightness will be lowered.

And if the total length of the lamp and the tube diameter are increased then the lengths of the corresponding external electrodes will be lengthened to obtain constant brightness. However, if the lengths of the external electrodes is increased then the effective light emitting area will be decreased, such that when it is used as the back light, the external electrode portion is large and non-light-emitting area of the panel is increased, which acts a negative factor to efficiency of the lamp.

Therefore, according to the usage fields, the lamp having a longer length as well as a larger tube diameter are required for the external electrode fluorescent lamp, but at present above mentioned problems still remain.

SUMMARY OF INVENTION

Thus the object of present invention is, for the case that an external electrode fluorescent lamp having longer length is required, to provide the external electrode fluorescent lamp and manufacturing method thereof, wherein the required brightness can be obtained, as well as the lengths of external electrodes acting as the non-light-emitting areas can be decreased.

To achieve above mentioned object, the present inventor made the present invention by increasing the total length of the external electrode fluorescent lamp according to the usages, by providing in contrast to the conventional art in which the length of the external electrode was increased, separately a glass tube on which the external electrode is formed, and by increasing the diameter of the glass tube larger than that of the glass tube body coated with fluorescent material.

To achieve above mentioned object, according to one embodiment of the present invention, provided is a manufacturing method of a dual external electrode fluorescent lamp. The manufacturing method of the fluorescent lamp is characterized by comprising: (i) a step of providing a $1^{st}$ glass tube that has both ends opened thereof and an inner wall thereof coated with a fluorescent material, wherein the diameter of the opened ends is extended; (ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube; (iii) a step of joining $1^{st}$ multi-tube for the enlargement of an electrode area in the one $2^{nd}$ glass tube or a 'flare' structure having one closed end to one end of one $2^{nd}$ glass tube through insertion after spreading one end widely, and a step of enlarging an electrode area in the other $2^{nd}$ tube and joining a $2^{nd}$ multi-tube having an exhaust port to the other $2^{nd}$ tube through insertion; and (iv) a step of cutting and sealing a portion of the exhaust port after vacuumizing the inside of the glass tubes and injecting discharge gas inside the glass tubes through the connection of an exhaust system to the exhaust port. And, the method comprises a step of forming the diameters of the two $2^{nd}$ glass tubes joined at both opened ends of the $1^{st}$ glass tube being extended, being reduced, or having same diameters than those of the both opened ends of the $1^{st}$ glass tube.

An another manufacturing method of the fluorescent lamp is characterized by comprising: (i) a step of providing a $1^{st}$ glass tube that has both ends opened thereof and an inner wall thereof coated with a fluorescent material, wherein the diameter thereof is homogeneous; (ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube; (iii) a step of joining $1^{st}$ multi-tube for the enlargement of an electrode area in the one $2^{nd}$ glass tube or a 'flare' structure having one closed end to one end of one $2^{nd}$ glass tube through insertion after spreading one end widely, and a step of enlarging an electrode area in the other $2^{nd}$ tube and joining a $2^{nd}$ multi-tube having an exhaust port to the other $2^{nd}$ tube through insertion; and (iv) a step of cutting and sealing a portion of the exhaust port after vacuumizing the inside of the glass tubes and injecting discharge gas inside the glass tubes through the connection of an exhaust system to the exhaust port. And, the method comprises a step of forming the diameters of the two $2^{nd}$ glass tubes joined at both opened ends of the $1^{st}$ glass tube being extended, being reduced, or having same diameters than those of the both opened ends of the $1^{st}$ glass tube.

The $2^{nd}$ glass tube may have same diameters at its ends, or may have different diameters at its ends.

And an another manufacturing method of the fluorescent lamp is characterized by comprising: (i) a step of providing a $1^{st}$ glass tube that has both ends opened thereof and an inner wall thereof not coated with a fluorescent material, wherein the diameter of the opened ends is not extended; (ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube; (iii) a step of coating a fluorescent material as the $1^{st}$ glass tube and the two $2^{nd}$ glass tubes are joined; (iv) a step of removing the fluorescent material at any one of the two joined $2^{nd}$ glass tubes; (v) a step of joining $1^{st}$ multi-tube for the enlargement of an electrode area in the one $2^{nd}$ glass tube or a 'flare' structure having one closed end to one end of one $2^{nd}$ glass tube through insertion after spreading one end widely, and a step of enlarging an electrode area in the other $2^{nd}$ tube and joining a $2^{nd}$ multi-tube having an exhaust port to the other $2^{nd}$ tube through insertion; and (vi) a step of cutting and sealing a portion of the exhaust port after vacuumizing the inside of the glass tubes and injecting discharge gas inside the glass tubes through the connection of an exhaust system to the exhaust port.

The foregoing and other features and aspects of the invention will be best understood with reference to the following description of certain exemplary embodiments of the invention, when read in conjunction with the accompanying drawings.

As mentioned above, the invention is able to obtain a desirable area for an external electrode by providing multi-tube shaped $2^{nd}$ glass tube and another $2^{nd}$ glass tube having an external electrode without lengthily extending the length of the external electrode for the obtainment of desirable luminance if a long external electrode fluorescent lamp is required depending on the use of the lamp. Accordingly, a non-luminous region resulting from the external electrodes in a long external electrode fluorescent lamp can be reduced.

| <DESCRIPTION OF NOTATIONS IN DRAWINGS> | |
|---|---|
| 100: | $1^{st}$ glass tube |
| 200: | $2^{nd}$ glass tube |
| 200': | another $2^{nd}$ glass tube |
| 300: | $1^{st}$ multi-tube |
| 400: | $2^{nd}$ multi-tube |

DETAILED DESCRIPTION OF THE INVENTION

In the following description of manufacturing an external electrode fluorescent lamp in conjunction with the accompanying drawings, the description about the manufacturing processes already known in the art, the typically performable processes, and the composition or operation of known apparatuses are omitted. And although it is rendered as the characteristic composition of the present invention may be applied to the external electrode fluorescent lamp, it may be well appreciated by a person having knowledges of the art that the invention also may be applied to a neon sign using the glass tube not coated with a fluorescent material.

Figure 1:
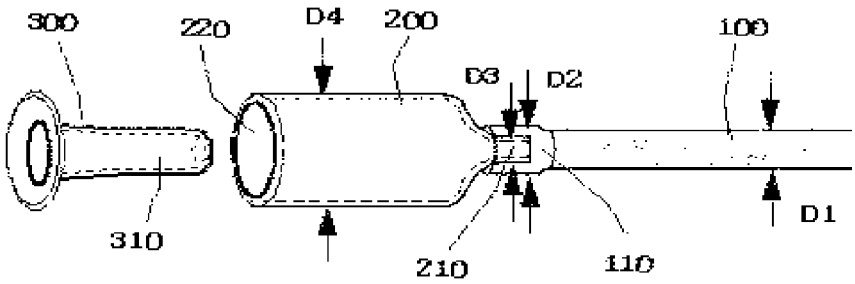
FIG. 1 shows a structure of a dual external electrode fluorescent lamp, provided in accordance with an embodiment of the invention.
Figure 1:
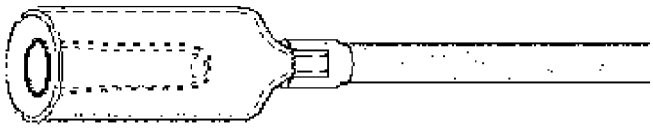

FIG. 1 roughly shows a structure of a dual external electrode fluorescent lamp, provided in accordance with one embodiment of the invention. In particularly, FIG. 1(*a*) shows when a $1^{st}$ glass tube (100) and a $2^{nd}$ glass tube (200) are joined but a $1^{st}$ multi-tube (300) for the enlargement of an electrode area is not joined. FIG. 1(*b*) shows when the $1^{st}$ glass tube (100) and the $2^{nd}$ glass tube (200) are joined and the $1^{st}$ multi-tube (300) for the enlargement of an electrode area is also joined. And it shows the both ends of the $1^{st}$ glass tube being extended.

In FIG. 1, it should be noted that only the left part of a dual external electrode fluorescent lamp is depicted.

And, for completion of the lamp a sealing process should be performed, it could be performed in many ways, so detailed description about it is omitted.

As depicted in the figure, a dual external electrode fluorescent lamp includes a $1^{st}$ glass tube 100 and a $2^{nd}$ glass tube 200 joined with a multi-tube for electrode, which are joined with each other. An external electrode (not shown) is formed on the inner wall of the multi-tube joined to the surface and inside of the $2^{nd}$ glass tube 200. An discharging gas is contained in the glass tubes.

The end 110 of the $1^{st}$ glass tube is opened, and the inner wall of the glass tube is coated with a fluorescent material except the portion of the end. And as depicted in the figure, the diameter D2 of the opened end 110 is expanded larger than the diameter D1 of the body of the $1^{st}$ glass tube. Although not shown in the figure, the present invention may include a $1^{st}$ glass tube having a homogeneous diameter on its whole length.

The $2^{nd}$ glass tube 200 has both ends 210 and 220 opened, and its one opened end 210 is joined with the opened end 110 of the $1^{st}$ glass tube. In the other hand, as depicted in the figure, the $2^{nd}$ glass tube has a larger diameter D4 than the diameter D1 of the $1^{st}$ glass tube. According to a preferred embodiment of the invention, the one opened end 210 may be reduced for easy joining with the opened end 110 of the $1^{st}$ glass tube.

The diameter D3 of the reduced opened end 210 may be smaller or larger than, or same as the diameter D2 of the opened end of the $1^{st}$ glass tube 100.

The dual external electrode fluorescent lamp having structure as described above, provides the $2^{nd}$ glass tube 200 in which the external electrode forms separate from the $1^{st}$ glass tube, and the diameter D4 is larger than the diameter D1 of the $1^{st}$ glass tube, so that, in cases an external electrode fluorescent lamp having longer length is required according to various usages, without necessarily lengthening the external electrode, the area for desired luminance may be obtained and hence non-light-emitting area due to the external electrode could be reduced. And this effect may be maximized by joining the $1^{st}$ multi-tube 300 for the enlargement of an electrode area.

According to the invention a manufacturing method of the dual external electrode fluorescent lamp is characterized by comprising: (i) a step of providing a $1^{st}$ glass tube that has both ends opened thereof and an inner wall thereof not coated with a fluorescent material, wherein the diameter of the opened ends is not extended;

(ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube;

(iii) a step of coating a fluorescent material as the $1^{st}$ glass tube and the two $2^{nd}$ glass tubes are joined;

(iv) a step of removing the fluorescent material at any one or two of the two joined $2^{nd}$ glass tubes;

(v) a step of joining $1^{st}$ multi-tube for the enlargement of an electrode area in the one $2^{nd}$ glass tube or a 'flare' structure having one closed end to one end of one $2^{nd}$ glass tube through insertion after spreading one end widely, and a step of enlarging an electrode area in the other $2^{nd}$ tube and joining a $2^{nd}$ multi-tube having an exhaust port to the other $2^{nd}$ tube through insertion; and (vi) a step of cutting and sealing a portion of the exhaust port after vacuumizing the inside of the glass tubes and injecting discharge gas inside the glass tubes through the connection of an exhaust system to the exhaust port.

In below, the detail of a manufacturing method of the dual external electrode fluorescent lamp having compositions as mentioned above will be described.

1. Joining a $1^{st}$ Glass Tube 100 with a $2^{nd}$ Glass Tube 200

First, as depicted in FIG. 1(*a*), a $1^{st}$ glass tube 100 for the external electrode fluorescent lamp is prepared. The $1^{st}$ glass tube 100 has both ends opened thereof and an inner wall thereof coated with a fluorescent material, as in the usually performed process of the manufacturing procedure of general fluorescent lamp.

The diameters of both ends are preferably expanded so that those may become larger than the diameter of the body of the glass tube coated with the fluorescent material. More detailed description in relation to this will be followed.

Meanwhile, as depicted in the figure, according to the preferred embodiment of the invention, it is not that the whole area of the inner wall of the $1^{st}$ glass tube 100 is coated with the fluorescent material. The fluorescent material is not coated on the portion of the both end 110 that shall be joined with the opened end 210 of the $2^{nd}$ glass tube 200 later. That is, it is preferred that the fluorescent material is not coated at joining areas of the glass tubes as the fluorescent material may hinder the joining process of the glass tubes.

Then, a $2^{nd}$ glass tube 200 that shall be joined with the $1^{st}$ glass tube 100 is prepared. As depicted in the figure, it can be seen that the diameter D4 of the $2^{nd}$ glass tube 200 is larger that the diameter D1 of the $1^{st}$ glass tube 100. That is, depending to specific usages a longer external electrode fluorescent lamp could be required, where the length of the external electrode could become proportionally larger for obtaining desired luminance since the length and/or tube-diameter of the lamp could become larger. However, when the external electrode becomes larger, the efficiency of the lamp could be reduced as the effective light emitting area could be reduced and the non-light-emitting area could be increased in the whole lamp area.

According to the present invention, the external electrode fluorescent lamp is not manufactured as a single glass tube. For solve problems of the conventional art, the invention provides separate glass tubes, glass tubes provided with the external electrodes and other glass tube coated with the fluorescent material, joins the glass tubes, and expands the diameters of the glass tubes provided with the external electrodes larger than the diameter of the glass tube coated with the fluorescent material.

Particularly, the $2^{nd}$ glass tube 200 provided with the external electrode, having the diameter D4 larger than the diameter D1 of the $1^{st}$ glass tube 100, is prepared so that a sufficient area for external electrode required depending usages could be obtained. That is, instead of preparing a glass tube of homogeneous diameter that has the longer portion provided with the external electrode corresponding the longer length of the lamp to obtain desired luminance etc., the external electrode is formed by preparing a $2^{nd}$ glass tube 200 that is different from a glass tube 100 coated with a fluorescent material and that has diameter larger than that of the glass tube, to obtain sufficient area for desired luminance.

As depicted, both ends of the $2^{nd}$ glass tube 200 are opened. According to a preferred embodiment of the present invention, the opened end 210 has its diameter reduced to join with the opened end 110 of the $1^{st}$ glass tube.

Subsequently, the $1^{st}$ glass tube 100 is joined with the $2^{nd}$ glass tube 200 such that the opened ends of two glass tubes are abutted on each other and joined by heating the two ends with a torch etc.

According to the present invention, for joining the two glass tubes, the two glass tubes may be held and rotated by a specific holder (non shown), and the abutted portion may be then heated and melted with the torch to join to each other. This join process for two glass tubes may prevent effectively some negative phenomenons such as twist of the glass tubes or collapse of the glass tubes.

In performing such join process, it is preferred that the diameter of the opened end 110 of the coated glass tube, that is, the $1^{st}$ glass tube 100 is expanded larger than the diameter of the $1^{st}$ glass tube. That is, as depicted in the figure, the diameter D2 of the opened end 110 is expanded larger than the diameter D1 of the $1^{st}$ glass tube. When joining the glass tubes 100 and 200, the glass tubes tend to contract due to high temperature. If the diameter D2 of the opened end 110 becomes smaller than the diameter D1 of the $1^{st}$ glass tube 100 due to high temperature, then the luminance difference of the lamp occurs, the electric resistance increases, and the external shape of the resulted lamp deteriorates. Considering these points, it is preferred that the diameter D2 of the opened end 110 of the $1^{st}$ glass tube 100 is processed to be larger than the diameter D1 of the $1^{st}$ glass tube.

Meanwhile, according to a preferred embodiment of the invention, for making easy to join two glass tubes, the opened ends 110 and 210 may be processed to have different diameters. At this time, the diameter D1 of the opened end 110 of the $1^{st}$ glass tube may be processed to be larger than, or smaller than the diameter D3 of the opened end 210 of the $2^{nd}$ glass tube. Also, according to another embodiment of the invention, the diameters D2 and D3 of the opened ends may be processed to be the same. However, it should be noted that it is also possible that the join process may be performed, without processing the opened end 210 of the $2^{nd}$ glass tube 200, by processing only the opened end 110 of the $1^{st}$ glass tube 100 and then joining to the $2^{nd}$ glass tube 200. That is, depending on embodiments, in case that the diameter D4 of the $2^{nd}$ glass tube 200 is not much larger than the diameter D1 of the $1^{st}$ glass tube 100, after simply processing only the opened end 110 of the $1^{st}$ glass tube, the joining process may be performed by inserting or abutting it into/onto the $2^{nd}$ glass tube. That is, the diameter may be the same along the whole length of the $2^{nd}$ glass tube.

After preparing the $1^{st}$ and $2^{nd}$ glass tubes through above mentioned processes, the join process of two glass tubes may be performed. As depicted in the figure, in case that the opened ends of the two glass tubes have different diameters the two opened ends may be joined by torch heating after inserting an opened end of smaller diameter into an opened end of larger diameter, while in case that the opened ends have same diameters the two ends may be joined by torch heating after abutting the two ends onto each other.

Also, according to the invention the $2^{nd}$ glass tube has structure of a double tube for enlargement of the electrode area. That is, a $1^{st}$ multi-tube 300 may be joined so as to form an empty space between the inner wall of the $2^{nd}$ glass tube and the outer wall thereof, as an another glass tube 310 having smaller diameter compared to the $2^{nd}$ glass tube.

2. Joining the $1^{st}$ Glass Tube 100 with the Other $2^{nd}$ Glass Tube 200'

After the join process of the $2^{nd}$ glass tube 200 with one opened end 110 of the $1^{st}$ glass tube 100 has completed, the join process of the other $2^{nd}$ glass tube 200' with the other opened end of the $1^{st}$ glass tube 100. This join process has an additional process, apart form the above mentioned join process. That is, for manufacturing the external electrode fluorescent lamp, a process for vacuumizing the inside of the lamp and a process for injecting inert gas (discharge gas) etc. must be performed.

According to the invention, for making easy such necessary processes and the join process of glass tubes of the invention, a $2^{nd}$ multi-tube 400 having new structure is provided. The $2^{nd}$ multi-tube has additionally an exhaust port 420 for vacuumizing and injecting gas, etc. In following description, repetitions related to the structure of above mentioned $1^{st}$ and $2^{nd}$ glass tubes are omitted.

(1) Structure of the Other $2^{nd}$ Glass Tube 200'

Figure 2:
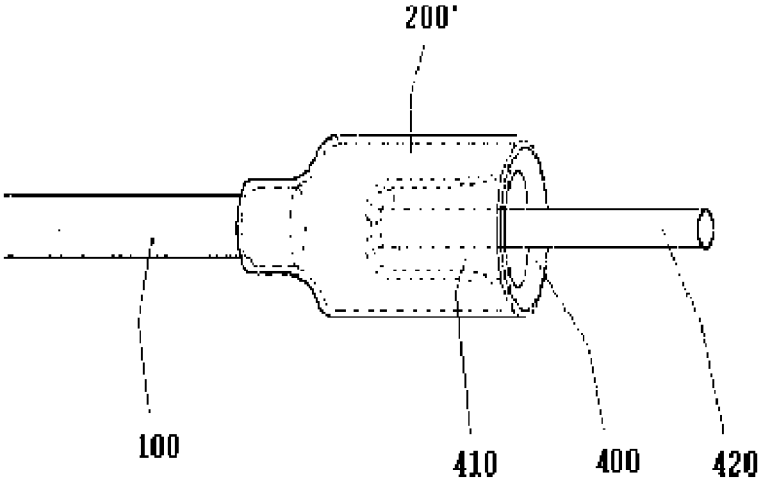
FIG. 2 shows an another joining structure of the two $2^{nd}$ glass tubes and the $1^{st}$ glass tube, provided in accordance with an embodiment of the invention.

As depicted in FIG. 2, for joining the other opened end of the $1^{st}$ glass tube 100 with a separate glass tube, the other $2^{nd}$ glass tube 200' joined with the $2^{nd}$ multi-tube 400 having the exhaust port is provided. The $2^{nd}$ multi-tube 400 has structure of a double tube such that it has an another glass tube 410 of same shape as the other glass tube 310 of FIG. 1, and it has the exhaust port 420 that one of its both ends is connected to an exhaust system (not shown) and the other end is joined to the other glass tube 410.

(2) Joining the $1^{st}$ Glass Tube 100 with the Other $2^{nd}$ Glass Tube 200'

As the process for joining of the $2^{nd}$ glass tube 200, the other $2^{nd}$ glass tube 200' is joined with the other opened end of the $1^{st}$ glass tube 100 through its one opened end.

Then, the processes for vacuumizing the inside of the glass tubes and injecting inert gas into the glass tubes through the exhaust port 420 connected to the exhaust system (not shown). When these processes had been completed, after lastly a process sealing the exhaust port is performed, the join process of the $1^{st}$ glass tube 100 and the other $2^{nd}$ glass tube 200' is completed.

After the join processes above mentioned of the $1^{st}$ glass tube 100, the $2^{nd}$ glass tube 200, and the other $2^{nd}$ glass tube 200' has been completed, the external electrode fluorescent lamp may be completed by forming the external electrodes on the surfaces of the $2^{nd}$ glass tube 200 and the other $2^{nd}$ glass tube 200' of multi-tube structure. Also, it should be noted that it is possible that above mentioned processes could be performed after the external electrodes had been formed at sections 320 of the $1^{st}$ glass tube 100 and the $2^{nd}$ glass tubes.

The above described manufacture method of the dual external electrode fluorescent lamp may be considered to include a process for coating the electrodes. And, the invention also includes the case that omits the process for coating the electrodes since the electrodes had already formed at the $2^{nd}$ glass tube and the other glass tube.

And, the invention also includes an dual external electrode fluorescent lamp manufactured by the manufacturing method of the dual external electrode fluorescent lamp.

Although not shown in the figures, the invention also includes a manufacturing method of the dual external electrode fluorescent lamp characterized by comprising: (i) a step of providing a $1^{st}$ glass tube that has both ends opened thereof and an inner wall thereof not coated with a fluorescent material, wherein the diameter of the opened ends is not extended; (ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube; (iii) a step of coating a fluorescent material as the $1^{st}$ glass tube and the two $2^{nd}$ glass tubes are joined; (iv) a step of removing the fluorescent material at any one or two of the two joined $2^{nd}$ glass tubes; (v) a step of joining $1^{st}$ multi-tube for the enlargement of an electrode area in the one $2^{nd}$ glass tube or a 'flare' structure having one closed end to one end of one $2^{nd}$ glass tube through insertion after spreading one end widely, and a step of enlarging an electrode area in the other $2^{nd}$ tube and joining a $2^{nd}$ multi-tube having an exhaust port to the other $2^{nd}$ tube through insertion; and (vi) a step of cutting and sealing a portion of the exhaust port after vacuumizing the inside of the glass tubes and injecting discharge gas inside the glass tubes through the connection of an exhaust system to the exhaust port.

Although the invention is described and depicted in conjunction with particular preferred embodiments. The present invention, however, is not to be considered as restricted to the specific embodiments depicted in accompanied figures and above described embodiments. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

The invention claimed is:

1. A manufacturing method of a dual external electrode fluorescent lamp characterized by comprising:

(i) a step of providing a $1^{st}$ glass tube that has both ends opened thereof and an inner wall thereof coated with a fluorescent material, wherein the diameter of the opened ends is extended;

(ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube;

(iii) a step of joining a $1^{st}$ multi-tube for the enlargement of an electrode area in one of the $2^{nd}$ glass tubes or a flare structure having one closed end to one end of the one $2^{nd}$ glass tubes through insertion after spreading the one end of the $2^{nd}$ glass tube widely, and a step of enlarging an electrode area in the other $2^{nd}$ tube and joining a $2^{nd}$ multi-tube having an exhaust port to the other $2^{nd}$ glass tube through insertion; and (iv) a step of cutting and sealing a portion of the exhaust port after vacuumizing the inside of the glass tubes and injecting discharge gas inside the glass tubes through the connection of an exhaust system to the exhaust port.

2. The method of claim 1, wherein the method comprises a step of forming the diameters of the two $2^{nd}$ glass tubes joined at both opened ends of the $1^{st}$ glass tube being extended, being reduced, or having same diameters than those of the both opened ends of the $1^{st}$ glass tube.

3. The methods of claim 2, wherein the method includes a successive process for coating the electrodes.

4. The methods of claim 2, the method omits a successive process for coating the electrodes since the electrodes had already formed at the $2^{nd}$ glass tube and the other glass tube having the $1^{st}$ multi-tube and the $2^{nd}$ multi-tube.

5. The methods of claim 1, wherein the method includes a successive process for coating the electrodes.

6. The methods of claim 1, the method omits a successive process for coating the electrodes since the electrodes had already formed at the $2^{nd}$ glass tube and the other glass tube having the $1^{st}$ multi-tube and the $2^{nd}$ multi-tube.

7. An dual external electrode fluorescent lamp manufactured by claim 1.

8. A manufacturing method of a dual external electrode fluorescent lamp characterized by comprising:

(i) a step of providing a $1^{st}$ glass tube that has both ends opened thereof and an inner wall thereof coated with a fluorescent material, wherein the diameter thereof is homogeneous;

(ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube;

(iii) a step of joining a $1^{st}$ multi-tube for the enlargement of an electrode area in one of the $2^{nd}$ glass tubes or a flare structure having one closed end to one end of the one $2^{nd}$ glass tube through insertion after spreading the one end of the $2^{nd}$ glass tube widely, and a step of enlarging an electrode area in the other $2^{nd}$ glass tube and joining a $2^{nd}$ multi-tube having an exhaust port to the other $2^{nd}$ tube through insertion; and (iv) a step of cutting and sealing a portion of the exhaust port after vacuumizing the inside of the glass tubes and injecting discharge gas inside the glass tubes through the connection of an exhaust system to the exhaust port.

9. The method of claim 8, wherein the method comprises a step of forming the diameters of the two $2^{nd}$ glass tubes joined at both opened ends of the $1^{st}$ glass tube being extended, being reduced, or having same diameters than those of the both opened ends of the $1^{st}$ glass tube.

10. The methods of claim 8, wherein the method includes a successive process for coating the electrodes.

11. The methods of claim 8, the method omits a successive process for coating the electrodes since the electrodes had already formed at the $2^{nd}$ glass tube and the other glass tube having the $1^{st}$ multi-tube and the $2^{nd}$ multi-tube.

12. A manufacturing method of a dual external electrode fluorescent lamp characterized by comprising:

(i) a step of providing a $1^{st}$ glass tube that has both ends opened thereof and an inner wall thereof not coated with a fluorescent material, wherein the diameter of the opened ends is not extended;

(ii) a step of mutually connecting the $1^{st}$ glass tube with two $2^{nd}$ glass tubes by joining both opened ends of the $1^{st}$ glass tube to the two both-end opened $2^{nd}$ glass tubes that include opened ends thereof and have a diameter larger than that of the $1^{st}$ glass tube;

(iii) a step of coating a fluorescent material as the $1^{st}$ glass tube and the two $2^{nd}$ glass tubes are joined;

(iv) a step of removing the fluorescent material at any one of the two joined $2^{nd}$ glass tubes;

(v) a step of joining a $1^{st}$ multi-tube for the enlargement of an electrode area in one of the $2^{nd}$ glass tubes or a 'flare' structure having one closed end to one end of the one $2^{nd}$ glass tube through insertion after spreading the one end of the $2^{nd}$ glass tube widely, and a step of enlarging an electrode area in the other $2^{nd}$ tube and joining a $2^{nd}$ multi-tube having an exhaust port to the other $2^{nd}$ glass tube through insertion; and (vi) a step of cutting and sealing a portion of the exhaust port after vacuumizing the inside of the glass tubes and injecting discharge gas inside the glass tubes through the connection of an exhaust system to the exhaust port.

13. An dual external electrode fluorescent lamp manufactured by claim 12.

* * * * *